US005253775A

United States Patent [19]

Gould

[11] Patent Number: 5,253,775

[45] Date of Patent: Oct. 19, 1993

[54] COMBINED HAMPER AND LAUNDRY BAG

[76] Inventor: Laurence P. Gould, 301 Chestnut St., Haddonfield, N.J. 08033

[21] Appl. No.: 823,767

[22] Filed: Jan. 22, 1992

[51] Int. Cl.[5] ..... B65D 25/16

[52] U.S. Cl. ..... 220/403; 220/909; 383/9; 248/100

[58] Field of Search ..... 220/403, 400, 404, 481, 220/909; 248/95, 100, 205.3, 222.4; 383/117, 102, 103, 9

[56] References Cited

U.S. PATENT DOCUMENTS

| | | | |
|---|---|---|---|
| 1,962,661 | 6/1934 | Kruschwitz | 248/100 |
| 2,602,482 | 7/1952 | Lyon | 383/117 |
| 2,625,973 | 1/1953 | Weldon et al. | 220/404 |
| 2,636,800 | 4/1953 | Downey | 220/400 |
| 2,736,454 | 2/1956 | McConnell | 220/404 |
| 2,754,991 | 7/1956 | Hagerty et al. | 220/481 |
| 2,947,464 | 8/1960 | Newton | 383/9 |
| 2,964,173 | 12/1960 | Schnabel | 220/481 |
| 3,646,723 | 3/1972 | Meroney | 383/9 |
| 4,101,104 | 7/1978 | Minard | 248/205.3 |
| 4,175,603 | 11/1979 | Iaboni | 383/9 |
| 4,492,169 | 1/1985 | Ware et al. | 248/222.4 |
| 4,558,800 | 12/1985 | Isgar et al. | 248/205.3 |
| 4,630,312 | 12/1986 | Milstein | 383/117 |
| 5,050,998 | 9/1991 | Wachtel | 383/9 |

FOREIGN PATENT DOCUMENTS

| | | | |
|---|---|---|---|
| 9005673 | 5/1990 | World Int. Prop. O. | 248/95 |

*Primary Examiner*—Allan N. Shoap
*Assistant Examiner*—S. Castellano
*Attorney, Agent, or Firm*—Norman E. Lehrer; Bryan D. Rockwell

[57] ABSTRACT

A combined hamper and laundry bag which provides a convenient arrangement for separating and maintaining separation of small laundry items from large items prior to washing and throughout the washing and drying cycle. The bag comprises a mesh bag portion having one open end, a latching strip for hanging the bag, and an adhesive backed mounting strip for engaging the latching strip. The openings comprising the mesh bag are of adequate size to allow sufficient water flow. The latching strip is permanently attached to the open end of the bag and is comprised of two strips of reinforced and durable material sewn together at their ends with an opening therebetween. At the ends of the latching strips, keyholes are formed to provide for engagement with the mounting strip. The mounting strip has adhesive on one side for attachment to the inside surface of the clothes hamper. On its other side, the strip has two knobs extending therefrom for engagement with the keyholes. After assembly, the bag is filled with small laundry items and then is removed and placed with the laundry into the washer and dryer thereby maintaining separation.

8 Claims, 1 Drawing Sheet

COMBINED HAMPER AND LAUNDRY BAG

BACKGROUND OF THE INVENTION

The present invention relates to the orderly storage of laundry items. More specifically, it relates to an arrangement for preventing the loss of small laundry items.

In every household there exists the problem of keeping track of small laundry items, most problematic are the freewheeling socks. Everyone has met the sock bandit, the unexplainable force that makes off with, most frequently, one sock of a matching pair. Usually, the sock turns up a short time later but more often than not after you've lost your need for it.

A variety of bags have been developed for storage of laundry items U.S. Pat. No. 2,015,119 to McEwen discloses a laundry container having a large bag with a small bag permanently attached thereto. The McEwen invention was developed to be used by launderers cleaning laundry from a large variety of people. The large bag was for the larger clothes items while the smaller bag was for the smaller items. The smaller bag was not removable but acted as a process to wash all the laundry together yet keep it separated so that the smaller items were not lost. The invention is not for continuous storage until full, it pertains to use only at the time of wash.

U.S. Pat. No. Des. 134,134 to Kyle discloses a laundry basket apparently to be used with clothesline hanging. The basket has two open, non-washable pouches attached to the basket to store clothespins.

U.S. Pat. No. 2,602,482 to Lyon discloses a washing bag to be used with laundry. The bag is washable and sealable and made from a mesh-like material that withstands wear from washing. The bag is not attachable to any other surface and is generally for large laundry items.

U.S. Pat. No. 4,228,834 to Desnick discloses a soap bag for storing soap in the bath. The bag is constructed from a mesh like material and has a strap/hook arrangement for hanging in the shower. It is not necessarily washable or durable for automatic wash. The open end is sealable.

Finally, U.S. Pat. No. 4,974,967 to Tsuyoshi discloses a laundry net for washing clothes maintained therein. The net is primarily for large clothes items having no means for separating the smaller items. The net is washable and sealable having a unique construction which allows its contents to obtain equal washing from all positions.

SUMMARY OF THE INVENTION

The invention in the present application is directed to the combination of a hamper and a durable, washable, and sealable bag used for washing and separating small laundry items, most particularly socks. The bag has means for being removably attached to the clothes hamper for convenience, ease of access, and efficiency.

In accordance with the invention, the bag comprises a washable mesh bag portion having one open end which is sealable via a zipper. The bag portion is formed from durable nylon mesh material wherein the openings forming the mesh are large enough to allow sufficient water flow for washing yet small enough to secure the contents within the bag. At its open end, the mesh bag is integrally attached to a latching strip which is formed from reinforced material. A keyhole is formed through the strip adjacent to each end thereof for hanging the sack on a mating component part.

The mating part can be an adhesive backed strip of equal size to the latching strip having two knobs extending therefrom at both ends of the strip. The knobs extend at locations which align with the keyholes. The knobs are "lollipop" shaped wherein the ball shaped half fits through the large part of the keyhole and the rod shaped part fits through the small part of the keyhole.

The keyholes fit over the knob and allow the sack to hang from the rod shaped section of the adhesive backed strip. The adhesive backed strip is preferably adhered to the inside surface of a clothes hamper.

Once the sock sack is hung it can be conveniently filled with small laundry items. When it is full it is disengaged from the knobs of the adhesive backed strip, zipped closed, and placed, bag and contents, into the washing machine and dryer. Upon completion, the contents are removed and the bag is hung up and ready to be refilled. The instant invention provides the person doing the laundry with the advantage of pre-washing separation of small laundry items from the large and also maintains this separation throughout washing and drying. This feature forestalls loss of small laundry items and avoids the annoying task of searching for and separating the small items from the large.

BRIEF DESCRIPTION OF THE DRAWINGS

For the purpose of illustrating the invention, there is shown in the accompanying drawings one form which is presently preferred; it being understood that the invention is not intended to be limited to the precise arrangements and instrumentalities shown.

DETAILED DESCRIPTION OF THE PREFERRED EMBODIMENT

Figure 2:
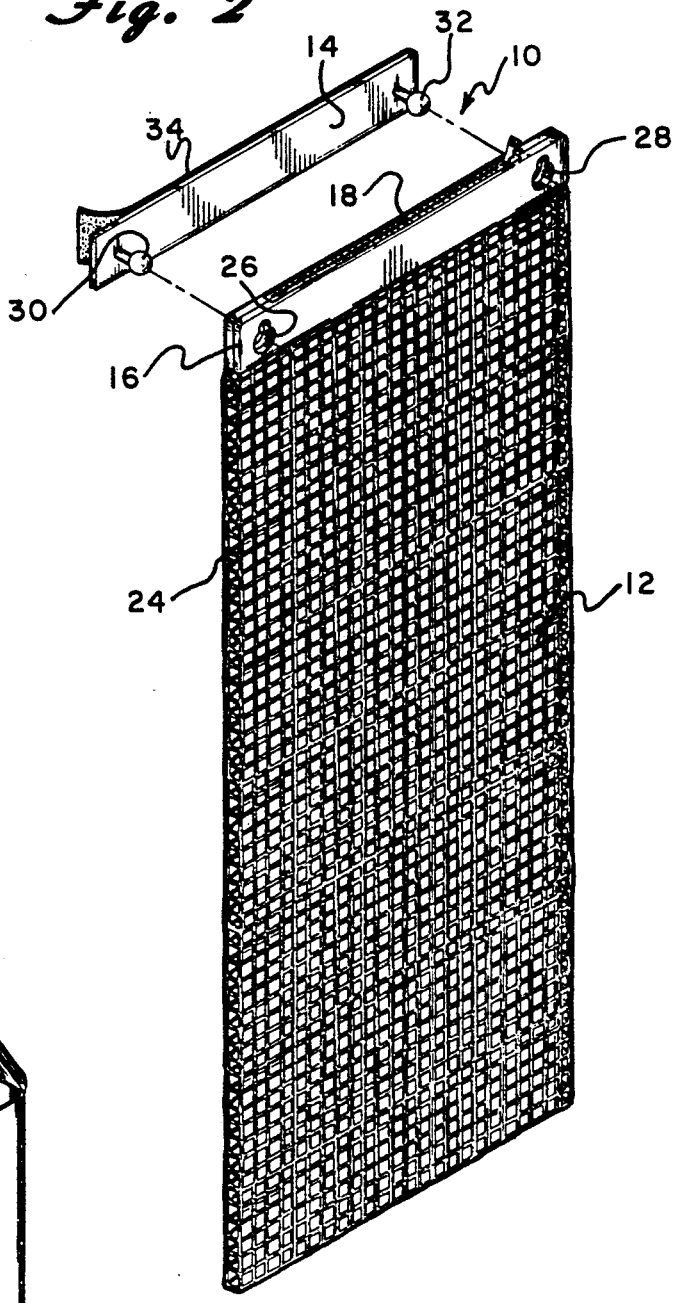
FIG. 2 is a perspective view of the laundry bag portion of the invention prior to its installation.

Referring now to the drawings in detail wherein like reference numerals have been used throughout the various figures to designate like elements there is shown in FIG. 2 a perspective view of the laundry bag portion of the invention constructed in accordance with the principles of the present invention and designated generally as 10. The bag assembly 10 is comprised of the mesh bag portion 12, the mounting strip 14, the latching strip 16, and the zipper 18. The latching strip 16 is integrally attached to the upper part of the mesh bag portion 12 and is constructed to engage the mounting strip 14. As shown in FIG. 2, the mounting strip 14 preferably is adhered to the inside surface 20 of a clothes hamper 22 for the most efficient use of the invention.

Figure 3:
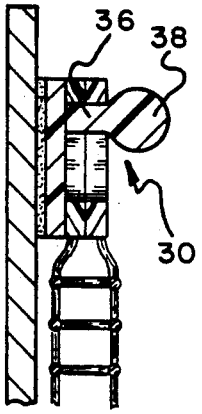
FIG. 3 is a cross-sectional view taken along line 3—3 of FIG. 1.

Referring now to FIGS. 2 and 3 for further detail of the component parts of the present invention, the mesh bag portion 12 is preferably constructed from a nylon mesh material or the like. The bag portion 12 is preferably twenty inches in length and eight inches in width and is constructed from a single piece of nylon attached at its ends. The mesh feature of the bag portion allows for water and soap movement through the bag portion for washing the clothes carried therein. The mesh openings 24 are of a size to allow sufficient flow of water to wash the enclosed clothes yet maintain the clothes therein throughout the washing cycle. The nylon material must also be flexible to allow the clothes to be easily inserted and removed.

The bottom end and sides of the bag portion 12 are permanently sealed but the top end of the bag portion 12 is open and integrally attached, preferably sewn, to the latching strip 16. The latching strip 16 is constructed from a reinforced, preferably cloth, material that is stronger than the mesh bag. The latching strip provides strength to the upper end of the bag portion for hanging yet maintains the open nature of the top end. Approximately one-half inch from each end of the first and second ends of the latching strip 16, keyhole openings 26 and 28 are formed therethrough for engaging the knobs 30 and 32 on the adhesive backed mounting strip 14. Zipper 18 is secured to the latching strip 16 adjacent to its top end preferably by sewing. The zipper allows for access to the interior of the bag portion and extends for approximately three quarters of the length of the latching strip on its horizontal center line.

The mounting strip 14 is approximately eight inches long, one inch wide, and a quarter-inch thick. It is preferably formed from plastic and preferably has an adhesive backing 34 on the back side thereof. In lieu of the adhesive backing, however, clips or mounting holes or the like could be provided to mount the strip 14 to the wall of the hamper.

On the opposite side, two knobs 30 and 32 extend from the mounting strip. The knobs 30 and 32 are also formed from plastic and are integrally connected to the mounting strip. The knobs are located on both the first and second ends of the strip 14 approximately one inch from the outer edge of each end and on the widthwise centerline of the strip. The knobs extend forwardly approximately one inch from the strip. The knobs are lollipop shaped and substantially identical so that only knob 32 will be described in detail it being understood that the description applies equally to both.

As shown in FIG. 3, the first half of the knob 30 is a rod-shaped portion 36 and the second half is a ball 38. The ball portion 38 is significantly larger in diameter than the rod-shaped portion 36. The ball portion 38 fits loosely within the larger portion of the keyhole opening 26 but not within the smaller portion of the keyhole. The rod shaped section 36 fits loosely within the smaller portion of the keyhole. This arrangement allows the adhesive backed mounting strip 14 to interlock with the latching strip 16 which maintains the sock sack in a secured condition relative to the chosen surface to which the adhesive backed mounting strip 14 is adhered.

Figure 1:
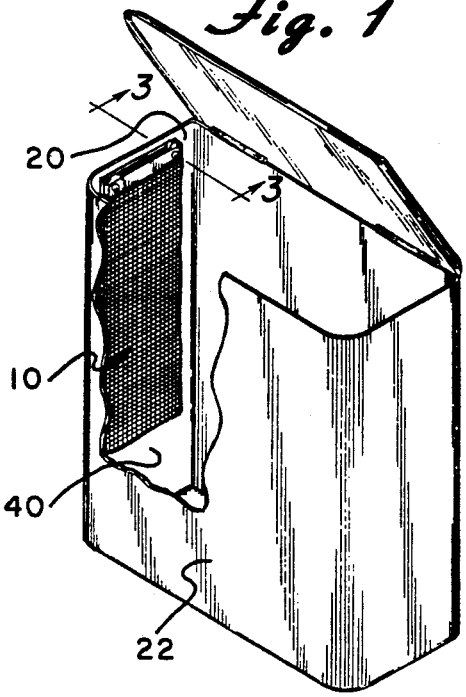
FIG. 1 is a perspective view of the combined clothes hamper and laundry bag constructed according to the principles of the present invention.

The bag portion 10 is designed essentially for storing small laundry items prior to washing and is used in the following manner. Referring to FIG. 1, the adhesive backed mounting strip 14 is first adhered to a flat surface, preferably the inside surface 20 of a clothes hamper 22, at a location to allow the bag 10 to hang freely. The bag 10 is engaged with the knobs 30 and 32 of the adhesive backed mounting strip via the keyhole openings 30 and 32 of the latching strip. The smaller portion of the keyholes rests on the rod-shaped portions of the knobs thereby securing the sock sack to the hamper. The laundry bag can now be used.

Small laundry items such as socks and underwear can be placed in the bag by unzipping the zipper and simply placing the items in the bag. When the bag is full, it is removed by slipping it over the knobs and the zipper 18 is closed. The sock bag can now be placed into a washing machine and will maintain separation of the small items from the larger items. When washing is finished, the bag and its contents can be similarly placed in a dryer. Upon completion of drying, the bag is emptied and replaced to the hamper for refilling.

The present invention may be embodied in other specific forms without departing from the spirit or essential attributes thereof and accordingly reference should be made to the appended claims rather than to the foregoing specification as indicating the scope of the invention.

What is claimed is:

1. An apparatus for storing and maintaining separation of small laundry items from large laundry items prior to and during a washing and drying process comprising:

(a) a hamper, said hamper having an open end and at least one vertical side wall;

(b) a bag for holding said small laundry items, said bag comprising a flexible bag portion having an open end for inserting small laundry items therein and having means for sealing said open end, said bag further including a latching strip permanently attached to said open end of said bag portion, said latching strip maintaining said open end in a substantially closed condition, said latching strip including first and second ends and having a keyhole opening located adjacent each of said first and second ends thereof, and (c) a mounting means enabling said bag to be removably attached directly to only said one vertical wall of said hamper, said mounting means being comprised of an elongated mounting strip and having a means for securing said mounting strip to said vertical wall of said hamper, said mounting strip having first and second ends and having knobs extending forwardly therefrom and located adjacent to each of said first and second ends of said mounting strip such that said knobs are in alignment with said keyhole openings of said latching strip for hanging said bag.

2. The invention according to claim 1 wherein said securing means is comprised of adhesive.

3. The invention according to claim 1 wherein said bag portion is formed of a material which is washable, dryable, durable and porous.

4. The invention according to claim 3 wherein said material is nylon having a mesh formation for allowing sufficient flow of water, soap and heating during said washing and drying process.

5. The invention according to claim 4 wherein said latching strip is comprised of two strips of reinforced material being rectangular in shape and equal in size, said strips being sewn together at their ends for maintaining said open end of said bag portion, said latching strip being sewn to said open end of said bag portion.

6. The invention according to claim 5 wherein said sealing means comprises a zipper permanently attached to said latching strip between said reinforced strips.

7. The invention according to claim 6 wherein said elongated strip is substantially rectangularly shaped and formed from a rigid plastic.

8. The invention according to claim 7 wherein said knobs are formed from plastic and are integrally connected to said elongated strip, said knobs being the shape of a sphere attached to an end of a rod extending from said elongated strip.

* * * * *